US010883748B2

(12) United States Patent
Saboy et al.

(10) Patent No.: US 10,883,748 B2
(45) Date of Patent: Jan. 5, 2021

(54) METHOD FOR CONTROLLING A COMPRESSOR SYSTEM

(71) Applicant: BITZER Kuehlmaschinenbau GmbH, Sindelfingen (DE)

(72) Inventors: Manuel Saboy, Bodman-Ludwigshafen (DE); Kresten Kjaer Sørensen, Augustenborg (DE); Morten Heinild, Sønderborg (DK)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 111 days.

(21) Appl. No.: 16/044,665

(22) Filed: Jul. 25, 2018

(65) Prior Publication Data

US 2018/0328640 A1 Nov. 15, 2018

Related U.S. Application Data

(63) Continuation of application No. PCT/EP2016/051454, filed on Jan. 25, 2016.

(51) Int. Cl.
*F25B 1/10* (2006.01)
*F25B 49/02* (2006.01)

(52) U.S. Cl.
CPC ..... *F25B 49/022* (2013.01); *F25B 1/10* (2013.01); *F25B 2600/022* (2013.01); *F25B 2600/2519* (2013.01)

(58) Field of Classification Search
CPC ..... F25B 49/022; F25B 2600/022; F25B 1/10
See application file for complete search history.

(56) References Cited

U.S. PATENT DOCUMENTS 3,495,418 A 2/1970 Kapich
4,815,950 A 3/1989 Aoki et al.
(Continued)

FOREIGN PATENT DOCUMENTS

WO WO 2008/041996 A1 4/2008
WO WO 2014/031708 A1 2/2014

*Primary Examiner* — Filip Zec
(74) *Attorney, Agent, or Firm* — Reinhart Boerner Van Deuren P.C.

(57) ABSTRACT

Method for controlling a compressor system, arranged in a heat pumping circuit, said compressor system being designed to be operated at at least two different compressor capacity stages, said compressor capacity stages being adjusted by a capacity adjustment system enabling switching from one compressor capacity stage to another compressor capacity stage, said capacity adjustment system being controlled by a capacity selection signal defining the compressor capacity stage to be selected, said method comprising determining a capacity set value, determining a decision quantity on the basis of said capacity set value, determining a calculated capacity average value on the basis of capacity selection signals generated before, comparing said calculated capacity average value with said decision quantity and changing said compressor capacity stage to the next higher stage if the calculated capacity average value is below the decision quantity or changing said compressor capacity stage to the next lower stage if the calculated capacity average value is above the decision quantity, or not changing said compressor capacity stage if the calculated capacity average value meets said decision quantity.

33 Claims, 7 Drawing Sheets

(56) References Cited

U.S. PATENT DOCUMENTS

| | | | | |
|---|---|---|---|---|
| 7,762,091 | B2 * | 7/2010 | Jin | F25B 49/022 62/175 |
| 9,641,005 | B2 * | 5/2017 | Tsuchiya | H02J 2207/20 |
| 10,532,714 | B2 * | 1/2020 | Seid | H01H 39/006 |
| 2004/0148951 | A1 | 8/2004 | Loprete | |
| 2009/0308086 | A1 * | 12/2009 | Lifson | F25B 49/025 62/115 |
| 2010/0251692 | A1 * | 10/2010 | Kinde, Sr. | F02K 7/16 60/226.1 |
| 2013/0098084 | A1 | 4/2013 | Matsuo et al. | |
| 2018/0202689 | A1 * | 7/2018 | Ieda | F25B 49/022 |
| 2018/0313592 | A1 * | 11/2018 | Nakata | F25B 47/02 |

* cited by examiner

METHOD FOR CONTROLLING A COMPRESSOR SYSTEM

CROSS-REFERENCE TO RELATED PATENT APPLICATION

This application is a continuation of International application number PCT/EP2016/051454 filed on Jan. 25, 2016.

This patent application claims the benefit of International application No. PCT/EP2016/051454 of Jan. 25, 2016, the teachings and disclosure of which are hereby incorporated in their entirety by reference thereto.

BACKGROUND OF THE INVENTION

The invention relates to a method for controlling a compressor system in particular a refrigerant compressor system, arranged in a heat pumping circuit, said compressor system being designed to be operated at at least two different compressor capacity stages, said compressor capacity stages being adjusted by a capacity adjustment system enabling switching from one compressor capacity stage to another capacity stage, said capacity adjustment system being controlled by a capacity selection signal defining the compressor capacity stage to be selected.

A heat pumping circuit according to the present patent application is a circuit driven by supplied energy and transferring heat or thermal energy from a heat absorbing heat exchanger to a heat releasing heat exchanger by using said supplied energy.

Such a heat pumping circuit can be operated by mechanical energy, for instance when using a compressor, or heat as an energy source, for instance when using an absorption process.

Further such a heat pumping circuit can use different working media as refrigerants and different physical cycles such as for example a Carnot cycle or any other cycle.

Therefore a heat pumping circuit in particular comprises all kinds of refrigeration circuits.

There are various methods known for use in control logics for controlling a refrigerant compressor system.

However the known methods used in control logics have the disadvantage that they are not able to react fast enough on changes of the capacity set value.

One object of the present invention is therefore to present a method for controlling such a compressor system operating reactive enough in response to changes of the required capacity.

SUMMARY OF THE INVENTION

This object is solved by a method for controlling a refrigerant compressor system as defined above which according to the present invention comprises determining a capacity set value, determining a decision quantity on the basis of said capacity set value, determining a calculated capacity average value on the basis of capacity selection signals generated before, comparing said calculated capacity average value with said decision quantity and changing said compressor capacity stage to the next higher stage if the calculated capacity average value is below the decision quantity or changing said compressor capacity stage to the next lower stage if the calculated capacity average value is above the decision quantity or not changing said compressor capacity stage if the calculated capacity average value meets said decision quantity.

The advantage of the present system has to be seen in the fact that using the calculated capacity average value for comparing with the decision quantity on one hand enables to compare a reaction of the heat pumping circuit in the future with the decision quantity so that the system operates similar to a feed forward control.

Consequently the method is sufficiently responsive on changes of the capacity set value reflecting the required capacity.

In particular the method according to the present invention due to use of the capacity set average value represents a closed loop feed forward control when considering the heat pumping process.

Further the compressor capacity stages of the compressor system are in particular fixed compressor capacity stages, e.g. compressor capacity stages the compressor capacity of which is not variable but fixed, for example due to use of various combinations of compressors or compressor units having a fixed compressor capacity.

In particular the inventive concept does not provide a mandatory change between certain compressor capacity steps after defined time periods as it is known from pulse width modulation systems for compressor capacity control.

The inventive concept uses a closed loop algorithm for deciding on the basis of a capacity set value whether or not the compressor capacity stage is to be changed, so that the time periods between changes of the compressor capacity stage can vary between a fastest time period defining the fastest reaction and theoretically an infinite time period in case the load in the heat pumping circuit fits perfectly to one of the fixed compressor capacity stages.

With respect to the generation of the capacity set value no specific method has been outlined so far.

In general said capacity set value can be calculated on the basis of pressure and/or temperature in any section of the heat pumping circuit.

For example in case of refrigeration said capacity set value can be calculated on the basis of a demand signal at a heat absorbing section of said heat pumping circuit. But for example in case of heating said capacity set value can be calculated on the basis of a demand signal at a heat releasing section of said heat pumping circuit.

It is of particular advantage if said capacity set value is calculated on the basis of a demand signal detected at a heat absorbing section of said heat pumping circuit and a user set value for said heat pumping circuit.

With respect to the calculation of said calculated capacity average value it is of particular advantage if this calculated capacity average value is calculated by using a moving average so that the average on one hand is a value quite close to the actual capacity average value but on the other hand the value is free of rapid changes.

One preferred method provides that said calculated capacity average value is calculated by using an exponential moving average.

One specific type of such exponential moving average is a calculation of said calculated capacity average value by using a modified moving average.

With respect to the duration of the averaging period no further details have been given so far.

It is preferred that the calculated capacity average value is calculated by using an averaging period in the range from 10 seconds or more to 100 seconds or less.

An even more preferred time range for the calculation of the calculated capacity average value is from 20 seconds or more to 90 seconds or less.

In one version of the method according to the present invention the decision quantity can be the capacity set value.

The methods explained so far can operate at any change rate of said compressor capacity stages, which can cause problems at the capacity adjustment system.

In particular it is of advantage if the method comprises a change rate limitation action limiting the number of changes of compressor capacity stages per time unit to a desired level.

Such a change rate limitation action avoids that the compressor capacity stages are changed too often, and avoids problems with the capacity adjustment system, in particular problems due to wear and/or lifespan of components of the capacity adjustment system.

According to one version of the present invention the change rate limitation action comprises determining a capacity set value band on the basis of the capacity set value and using said capacity set value band as the decision quantity.

With respect to the capacity set value band it has been only defined that this capacity set value band is determined on the basis of the respective capacity set value.

It is of advantage if said capacity set value band is determined such that the respective capacity signal value is within said capacity set value band.

It is of particular advantage if said capacity set value band is determined to comprise deviations from the capacity set value in the range from ±1% to ±10% of the maximum capacity.

Accordingly the capacity set value band defines a range of capacity set values adjacent the respective capacity set value.

In another version of the method according to the present invention the change rate limitation action comprises the step of waiting at least for the expiry of a minimum time period after the last change of the compressor capacity stage before allowing a further change of the compressor capacity stage in order to reduce the number of changes of the compressor capacity stage.

The minimum time period enables to limit the maximum possible number of changes of compressor capacity stages per time unit and therefore to limit the number of adjustments of the compressor capacity stages capacity by the compressor capacity adjustment system.

In particular the minimum time period is within the range from 0.2 seconds or more up to 10 seconds or less, preferably in the range from 1 second or more up to 10 seconds or less.

In order to incorporate such a minimum time period requirement into the method explained before it is of advantage if a comparison of the calculated capacity average value with the decision quantity is only made after expiry of the minimum time period.

In order to further reduce switching back and forth between two compressor capacity stages it is provided that a change from one current compressor capacity stage to a next compressor capacity stage obtained by control signals identical with the control signals of the last compressor capacity stage is only possible after a defined reactivation time period.

This solution is of particular advantage for avoiding that one and the same valve configuration is adjusted too often.

This defined reactivation period is preferably greater than the minimum time period.

Usually the reactivation time period is defined to be greater than the duration of the current time period.

One particular advantageous method provides that the reactivation time period is greater than a last time period which is the time period which happened before the current time period.

A further advantageous solution provides as a change rate limitation action that each compressor capacity stage is associated with a snap band and that a change of the compressor capacity stage is prohibited in case a set quantity based on the compressor set value is within said snap band.

The provision of a snap band in particular increases the stability of the control at capacity set values close to the respective compressor capacity stage and in particular avoids unnecessary changes of the compressor capacity stage.

Preferably said snap band is determined to comprise deviations from said respective compressor capacity stage said snap band is associated with in the range from ±1% or more up to 5% or less of the maximum capacity.

The stabilization of the operation of the compressor in the respective compressor capacity stage is in particular achieved in case a change of the compressor capacity stage is only allowed if said calculated capacity average value is within or above said snap band and said set quantity is above said snap band.

Another advantageous solution provides that a change of the compressor capacity stage is only allowed if said calculated capacity average value is within or below the snap band and said set quantity is below said snap band.

The set quantity can be either the capacity set value itself or a capacity set average calculated on the basis of capacity set values existing before.

Use of said capacity set average calculated on the basis of capacity set values existing before enables to avoid fluctuations and therefore to reduce unnecessary changes of the compressor capacity stage.

In particular said capacity set average is calculated by using a moving average.

A preferred method provides that the capacity set average is calculated by using an exponential moving average.

Preferably the capacity set average is calculated by using a modified moving average.

In particular said capacity set average is calculated by using an averaging period in the range from 10 seconds or more to 100 seconds or less.

In particular it is provided that in all cases in which no explicit change of the compressor capacity stage is required the compressor capacity stage associated with said respective snap band is maintained.

The invention further relates to a compressor system arranged in a heat pumping circuit said compressor system being provided with a capacity adjustment system, having a capacity adjustment device with capacity adjustment means and a capacity adjustment controller, characterized in that said capacity adjustment controller is controlled by a capacity selection signal generated by a capacity controller system operating according to a method of one of the preceding claims.

The advantage of such a system is the same as outlined before in connection with the method according to the present invention.

In connection with such a refrigerant compressor system the capacity adjustment means are not further defined.

One preferred solution provides that said capacity adjustment means are controlling the operation of several compressors or compressor units in order to run the compressor system in various compressor capacity stages.

A further advantageous compressor system provides that said adjustment means are valves which in particular are blocking or unblocking the flow of refrigerant to the respective compressors or compressor units in order to adjust the compressor capacity stage.

A further advantageous solution provides that said capacity adjustment system and said capacity control system are arranged on said refrigerant compressor system as functionally integrated part thereof so that the compressor system has the capacity adjustment system and the capacity control system incorporated with all their functions to form a system unit and is therefore a fully operable unit if provided with a capacity set value.

In particular such a system unit presents one single unit to be sold to a customer and having the capacity adjustment device the capacity adjustment system and the capacity control system functionally adapted and adjusted to each other.

Further features and advantages of the present invention are disclosed in the following detailed description.

DETAILED DESCRIPTION OF THE INVENTION

Figure 1:
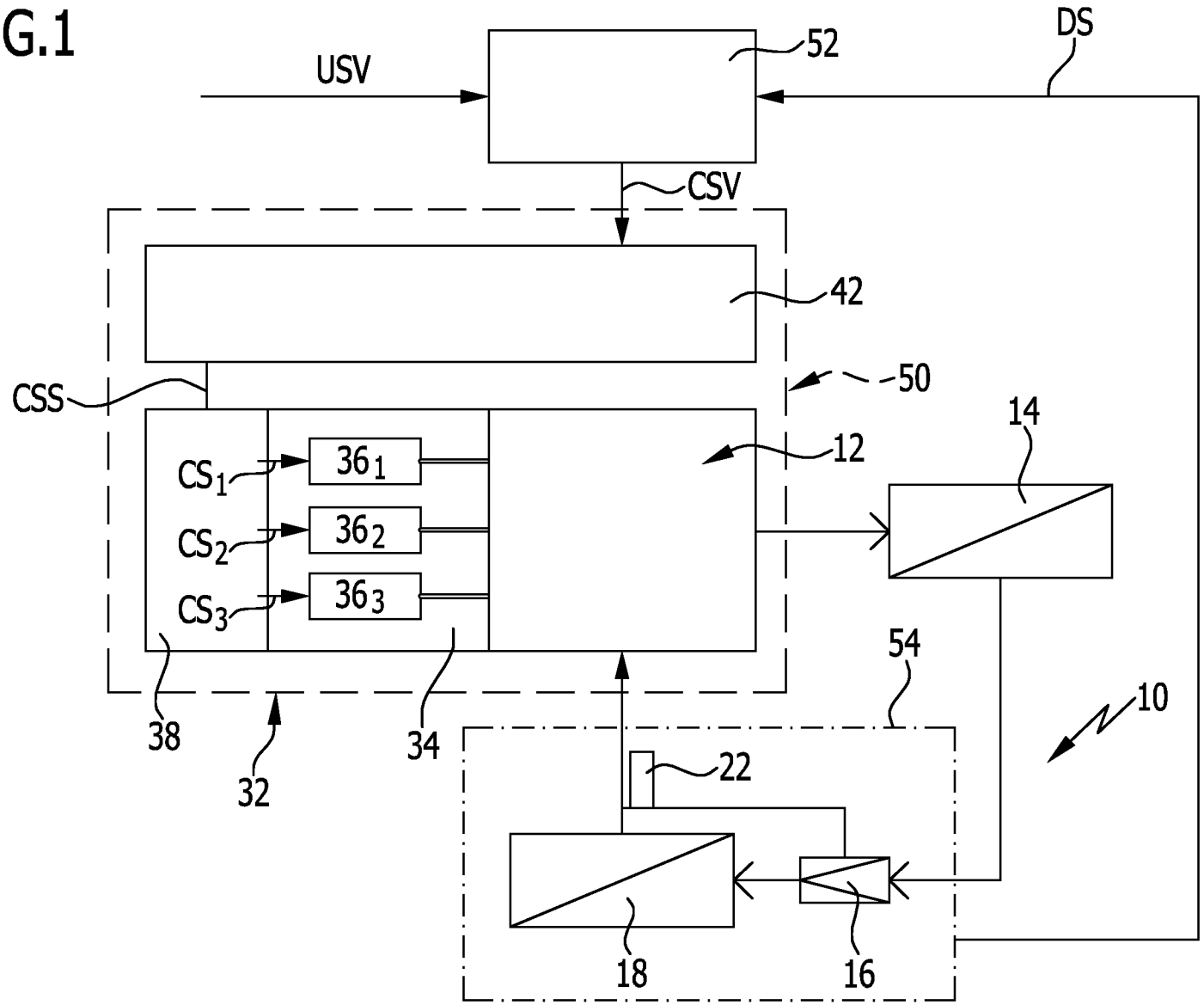
FIG. 1 shows the schematic concept of a heat pumping circuit with a compressor system as well as a capacity adjustment system associated with said compressor system and a capacity control system for control of the capacity adjustment system.

In a heat pumping circuit 10, shown in FIG. 1 there is provided a compressor system 12 followed by a heat releasing heat exchanger 14 receiving compressed refrigerant from said compressor system 12 and cooling said refrigerant by releasing heat.

Said cooled refrigerant is then transferred to an expansion unit 16 expanding that compressed and cooled refrigerant which is then transferred to a heat absorbing heat exchanger 18 receiving said expanded and cooled refrigerant and absorbing heat in order to warm up the refrigerant which is then passed from heat absorbing heat exchanger 18 back to compressor system 12 for compression.

Fox example, in the present embodiment the expansion unit 16 is controlled by a sensor 22 associated with said heat absorbing heat exchanger 18 in order to control expansion unit 16.

Other embodiments provide other expansion systems, such as expansions valves, in particular electronic expansion valves or expansion control systems.

Since that heat pumping circuit 10 is operated at different temperature levels the maximum compressor capacity of compressor system 12 is only needed in case of maximum load of heat pumping circuit 10 whereas in all other cases a lower compressor capacity is sufficient.

In order to save energy for running compressor system 12, compressor system 12 is provided with a capacity adjustment system 32 comprising a capacity adjustment device 34 directly associated with compressor system 12 and having capacity adjusting means 36, for example capacity adjusting means $\mathbf{36}_1$, $\mathbf{36}_2$, $\mathbf{36}_3$, controlled by control signals $CS_1$, $CS_2$, $CS_3$ which capacity adjustment means are for example valves, enabling to run the compressor system 12 at various compressor capacity stages CCS.

For example in case of two compressor capacity stages CCS of the compressor system 12 one compressor capacity stage CCS would have capacity 0% and the other compressor capacity stage CCS would have capacity 100%, of the maximum compressor capacity.

In case of for example three compressor capacity stages CCS one compressor capacity stage CCS would have 0%, one compressor capacity stage CCS would have 50% and the other compressor capacity stage CCS would have 100% of the maximum compressor capacity.

In case of for example four compressor capacity stages CCS one compressor capacity stage CCS would have 0%, another compressor capacity stage CCS would have 33%, another compressor capacity stage CCS would have 66% and another compressor capacity stage CCS would have 100% of the maximum compressor capacity.

These various compressor capacity stages CCS of the compressor system 12 can be either obtained by several compressors in the compressor system 12 and blocking compression by one or more of these several compressors with valves.

Another solution to obtain various compressor capacity stages CCS would be for example to have one compressor having different compression units and blocking compression by one or more of said compression units.

A further solution comprises the combination of both aforementioned solutions.

Such blocking of one or more compressors or compression units can be either achieved by using separate valves as capacity adjusting means $\mathbf{36}_1$ to $\mathbf{36}_3$ or using the existing valves of said compression units as said capacity adjusting means 36 and to interact with said existing valves of said compression units.

Due to mechanical design limitations the capacity adjustment means 36 should not switch more than 10 to 100 times per minute in the long term average, in order to maintain the system lifetime at a reasonable level.

The capacity adjusting means 36 are controlled by a capacity adjusting controller 38 of said capacity adjustment system 32.

Capacity adjusting controller 38 receives a capacity selection signal CSS defining the selected compressor capacity stage CCS of said compressor system 12 and capacity adjusting controller 38 according to said capacity selection signal CSS controls capacity adjusting means $\mathbf{36}_1$ to $\mathbf{36}_3$ by control signals $CS_1$ to $CS_3$ in order to run compressor system 12 at the selected compressor capacity stage CCS.

Capacity selection signal CSS is generated by a capacity control system 42. Said capacity control system 42 receives the capacity set value CSV generated by a system controller 52, which on the basis of a demand signal DS, detected for example at a heat absorbing section 54 of said heat pumping circuit, comprising said expansion unit 16 and said heat absorbing heat exchanger 18 and indicating the amount of heat to be transferred from the heat absorbing heat exchanger 18 to heat releasing heat exchanger 14. System controller 52 compares this demand signal DS with a user set value USV the system controller 52 is provided with.

According to a preferred concept compressor system 12, capacity adjustment system 32 and capacity control system 42 are combined to a system unit 50 which can be manufactured as a functionally integrated system unit 50, which is ready for implementation into the heat pumping circuit 10 and which needs only to be supplied with the capacity set value CSV for operation in said heat pumping circuit 10.

In a preferred embodiment the integrated system unit 50 includes controller 52 to calculate the capacity set value CSV.

Figure 2:
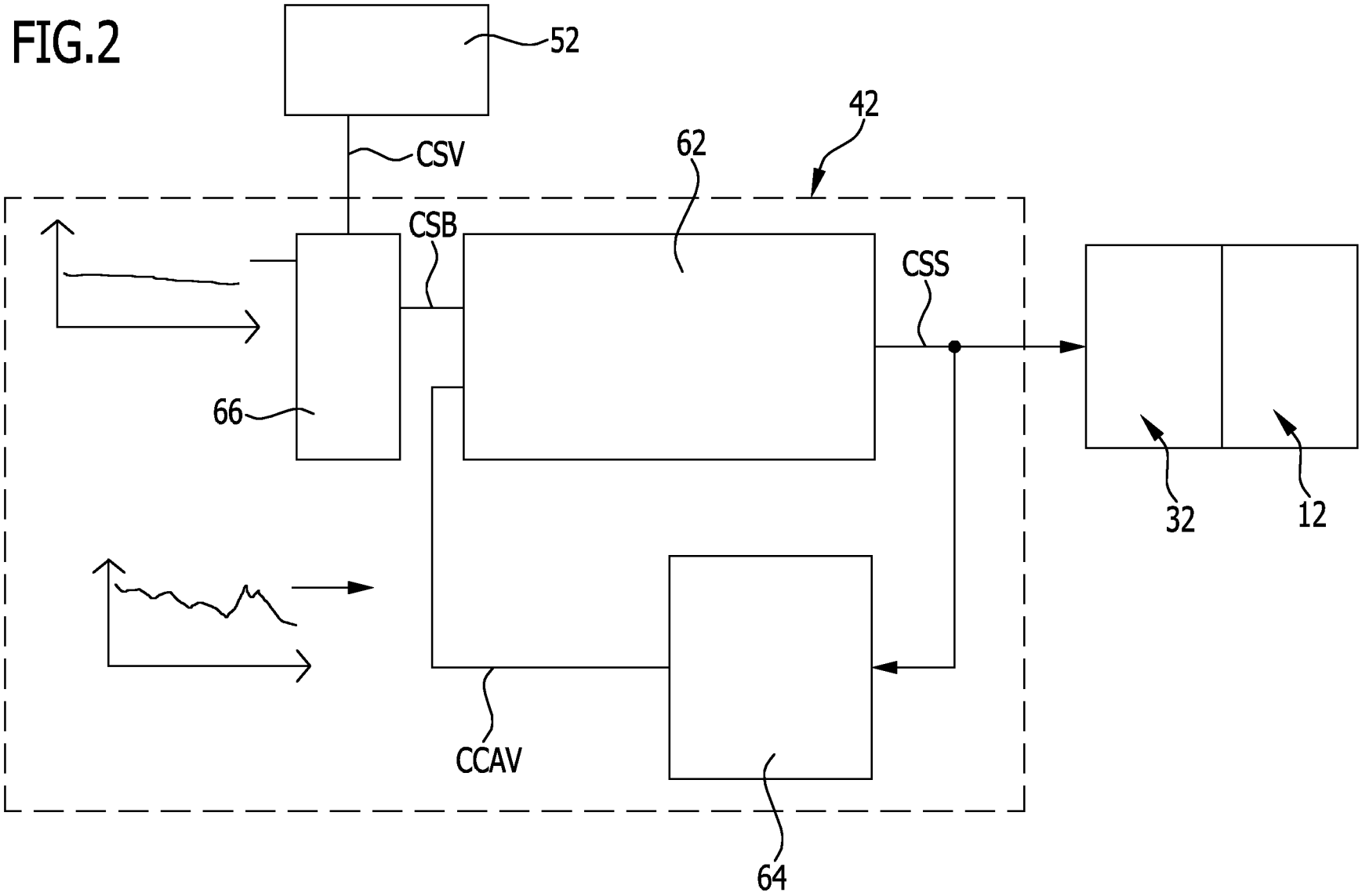
FIG. 2 shows a block diagram of the capacity control system according to the present invention.

As shown in FIG. 2 capacity controller 42 comprises a controller unit 62 generating said capacity selection signal CSS and an averaging unit 64 generating on the basis of the capacity selection signal CSS a calculated capacity average value CCAV.

The calculated capacity average value CCAV is usually calculated during an averaging period in the range between 20 seconds and 100 seconds, preferably in the range between 30 seconds or more and 90 seconds or less.

The calculation of the calculated capacity average value CCAV can be performed in several different ways.

It can be done for example by using an integrator sum, a ramp, a sliding window or a weighted moving average or an FIR-filter.

One preferred solution uses the method of an exponential moving average, in particular a modified moving average according to the formula $$AV(t)=AV(t-1)+(\text{input}-AV(t-1))/T.$$

Wherein AV (t) is the average value calculated for the time t, the "input" is the current input value and T is the time constant.

Capacity control system 42 operates by using a decision quantity DQ based on the capacity set value CSV which is to be compared with the calculated capacity average value CCAV.

In one simplified version the decision quantity DQ corresponds to the capacity set value CSV.

Figure 3:
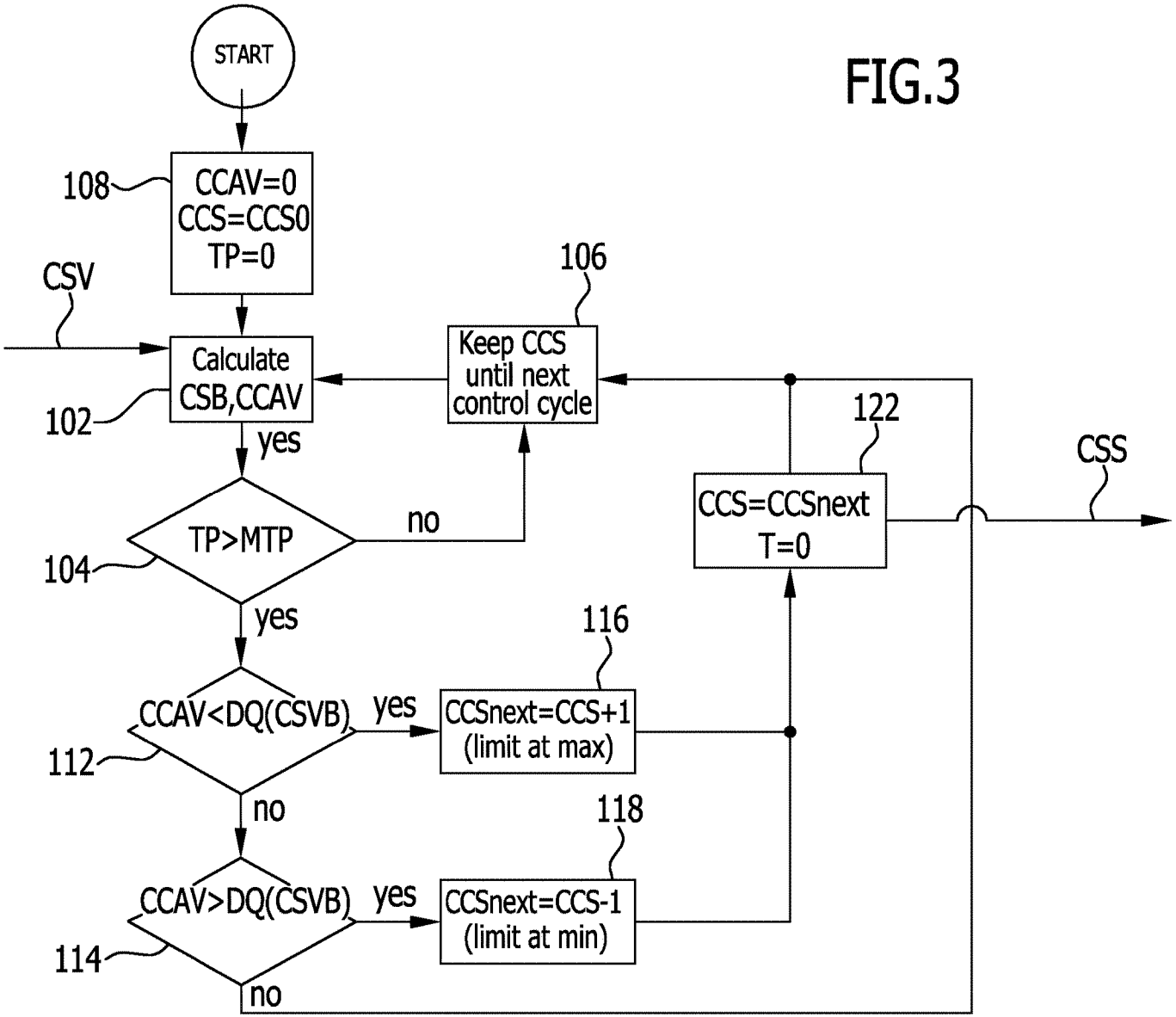
FIG. 3 shows a first embodiment of an algorithm and the various steps involved in the control cycle thereof.

In the first embodiment of an algorithm shown in FIG. 3 capacity control system 42 further comprises a bandwidth generating unit 66 which uses the capacity set value CSV to calculate a capacity set value band CSVB which defines a bandwidth of capacity set values CSV and which is calculated on the basis of capacity set value CSV generated by system controller 52 and which in the first embodiments represents the decision quantity DQ.

For example the capacity set value band CSVB has a bandwidth in the range from ±1% or more up to 10% or less of the maximum capacity of the compressor system 12.

For example for a capacity set value CSV of 40% of the maximum capacity the capacity set band can have a bandwidth in the range from 39% to 41% up to 30% to 50%.

The calculated capacity average value CCAV is supplied to control unit 62 together with capacity set value band CSVB for determination of the capacity selection signal CSS using calculated capacity average value CCAV and capacity set value band CSVB.

Use of a capacity set value band CSVB as the decision quantity DQ represents a change rate limitation action reducing the change rate of the compressor capacity stages, because no change will take place in case the calculated capacity average value CCAV is within the capacity set value band CSVB.

Control unit 62 can operate according to different embodiments of algorithms in order to calculate the capacity selection signal CSS.

The first embodiment of an algorithm shown in FIG. 3 starts the control cycle with a calculating step 102 according to which the capacity set value band CSVB is calculated on the basis of the capacity set value CSV and the calculated capacity average value CCAV is calculated on the basis of the capacity selection signals CSS outputted to the capacity adjustment system 32 in times before said calculation step 102 is started.

The first embodiment operates by using a further change rate limitation action which comprises a timing step 104.

In the timing step 104 the algorithm compares the time period TP which has passed after termination of the last change of the compressor capacity stage CCS with a minimum time period MTP which is defined to ensure that the capacity selection signal CSS is maintained at least for said minimum time period MTP.

If the time period TP passed after the last change of the compressor capacity stage CCS is smaller than the minimum time period MTP the algorithm returns to final algorithm step 106 which maintains the compressor capacity stage CCS until the next control cycle is started.

The minimum time period MTP is for example in the range between 1 second or more and 10 seconds or less.

If in timing step 104 it is decided that the time period TP passed after the last change of the compressor capacity stage CCS is greater than the minimum time period MTP comparison steps 112 and 114 are activated which compare the calculated capacity average value CCAV with the capacity set value band CSVB and in particular decide whether the calculated capacity average value CCAV is smaller or greater than the capacity set value band CSVB or within capacity set value band CSVB.

If the calculated capacity average value CCAV is within the capacity set value band CSVB the control cycle immediately returns to final algorithm step 106 and maintains the compressor capacity stage CCS until the next control cycle is started.

If however comparison step 112 for example discovers that the calculated capacity average value CCAV is smaller than the capacity set value band CSVB the control cycle activates capacity raising step 116 which defines that the next compressor capacity stage CCSnext corresponds to the next higher compressor capacity stage CCS+1.

If comparison step 114 discovers that calculated capacity average value CCAV is greater than the capacity set value band CSVB the control cycle activates capacity reducing step 118 defining that the next compressor capacity stage CCSnext corresponds to the next lower compressor capacity stage CCS−1.

If either one of capacity raising step 116 or capacity reducing step 118 has amended the current compressor capacity stage CCS the control cycle goes to capacity selection step 122 which generates a new capacity selection signal CSS by defining that the compressor capacity stage CCS has to correspond to the next compressor capacity stage CCSnext defined either in capacity raising step 116 or capacity reducing step 118.

Both capacity raising step 116 and capacity reducing step 118 are only amending the current compressor capacity stage CCS to the next higher or to the next lower compressor capacity stage CCS possible.

Further the capacity selection step 122 resets the time period TP to 0.

However the algorithm explained before and shown in FIG. 3 is also operable in the simplified version as mentioned before in which the decision quantity DQ corresponds to the capacity set value CSV and not to the capacity set value band CSVB.

Figure 4:
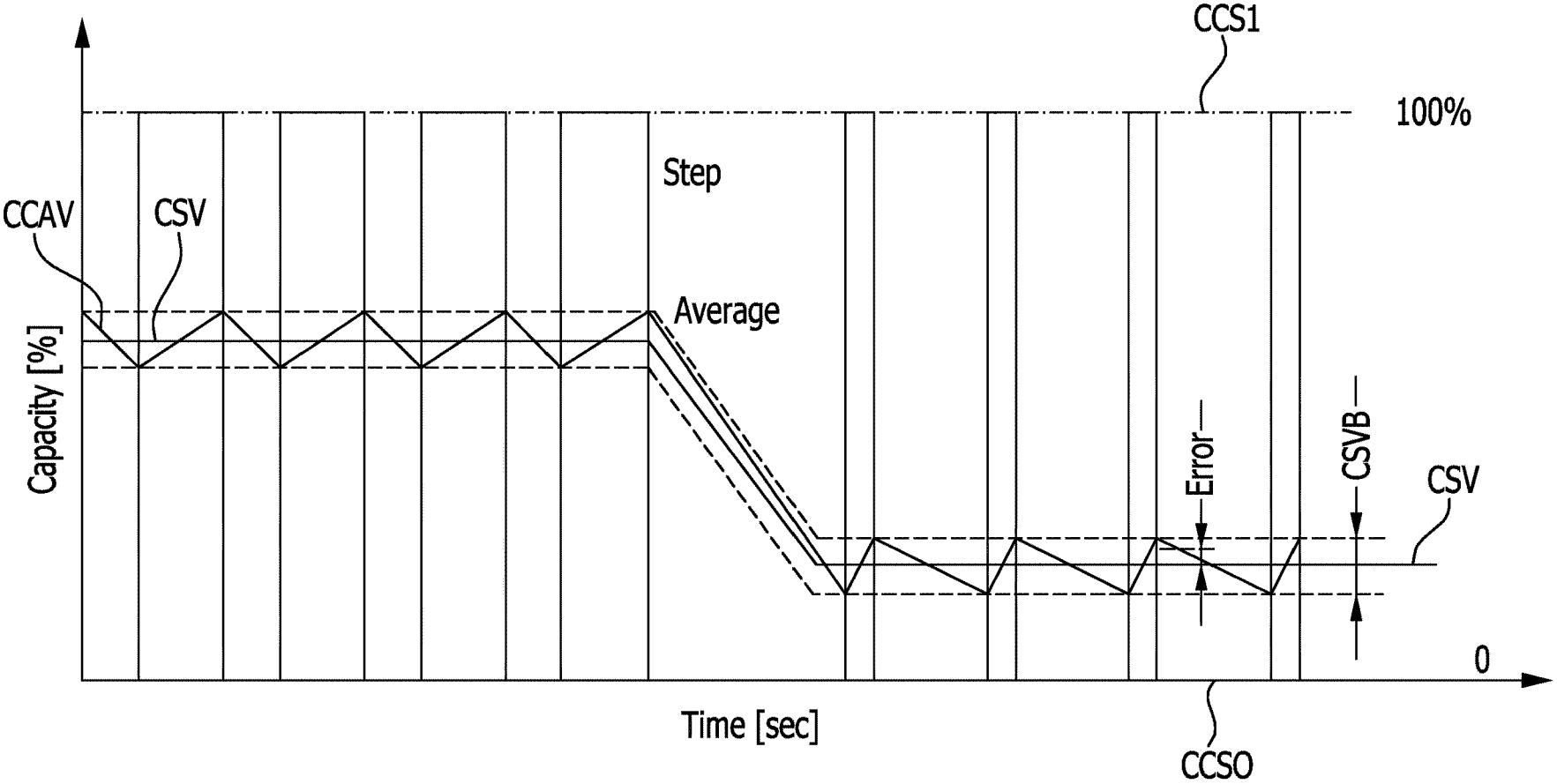
FIG. 4 shows a schematic representation of the compressor capacity stages and their adjustment depending on a compressor set value supplied to said capacity control system.

The operation of a compressor system 12 having for example two compressor capacity stages CCS, e.g. compressor capacity stage CCS0, which means capacity 0%, and compressor capacity stage CCS1, which means compressor capacity 100% of the maximum compressor capacity, is shown in FIG. 4.

Further the diagram in FIG. 4 shows the capacity set value CSV input to capacity controller system 42 and the calculated capacity average value CCAV calculated on the basis of the capacity selection signal CSS outputted by capacity controller system 42.

FIG. 4 also shows how, based on capacity set value CSV, the capacity set value band CSVB is calculated, for example by arranging capacity set value band CSVB symmetrical to capacity set value CSV so that capacity set value band CSVB comprises capacity set value CSV plus additional capacity values above and below capacity set value CSV.

FIG. 4 further shows that as long as the calculated capacity average value CCAV is within capacity set value band CSVB the compressor capacity stage CCS is not changed but at the moment the calculated capacity average value CCAV moves below capacity set value band CSVB the compressor capacity stage CCS is changed from CCS0 to CCS1 and if thereafter the calculated capacity average value CCAV moves to values above capacity set value band CSVB the compressor capacity stage CCS is changed from CCS1 to CCS0 again.

Depending on the capacity set value CSV the time periods TP for which the compressor capacity stages CCS0 and CCS1 are maintained are different.

For example in case of a capacity set value CSV above 50% the time periods for compressor capacity stage CCS0 are shorter than the time periods for compressor capacity stage CCS1, whereas in case the capacity set value CSV is about 20% the time periods for compressor capacity stage CCS1 are much shorter than time periods for compressor capacity stage CCS0.

Further the first embodiment of the algorithm according to the present invention comprises a starting step 108 activated for starting the algorithm when starting compressor system 12 in heat pumping circuit 10.

In this case the starting step 108 provides calculated capacity average value CCAV to be 0, compressor capacity stage CCS to be the lowest stage, which is CCS0, and also sets the time period TP passed after the last change of the compressor capacity stage CCS to be 0. With these starting values the algorithm begins at calculation step 102.

Figure 5:
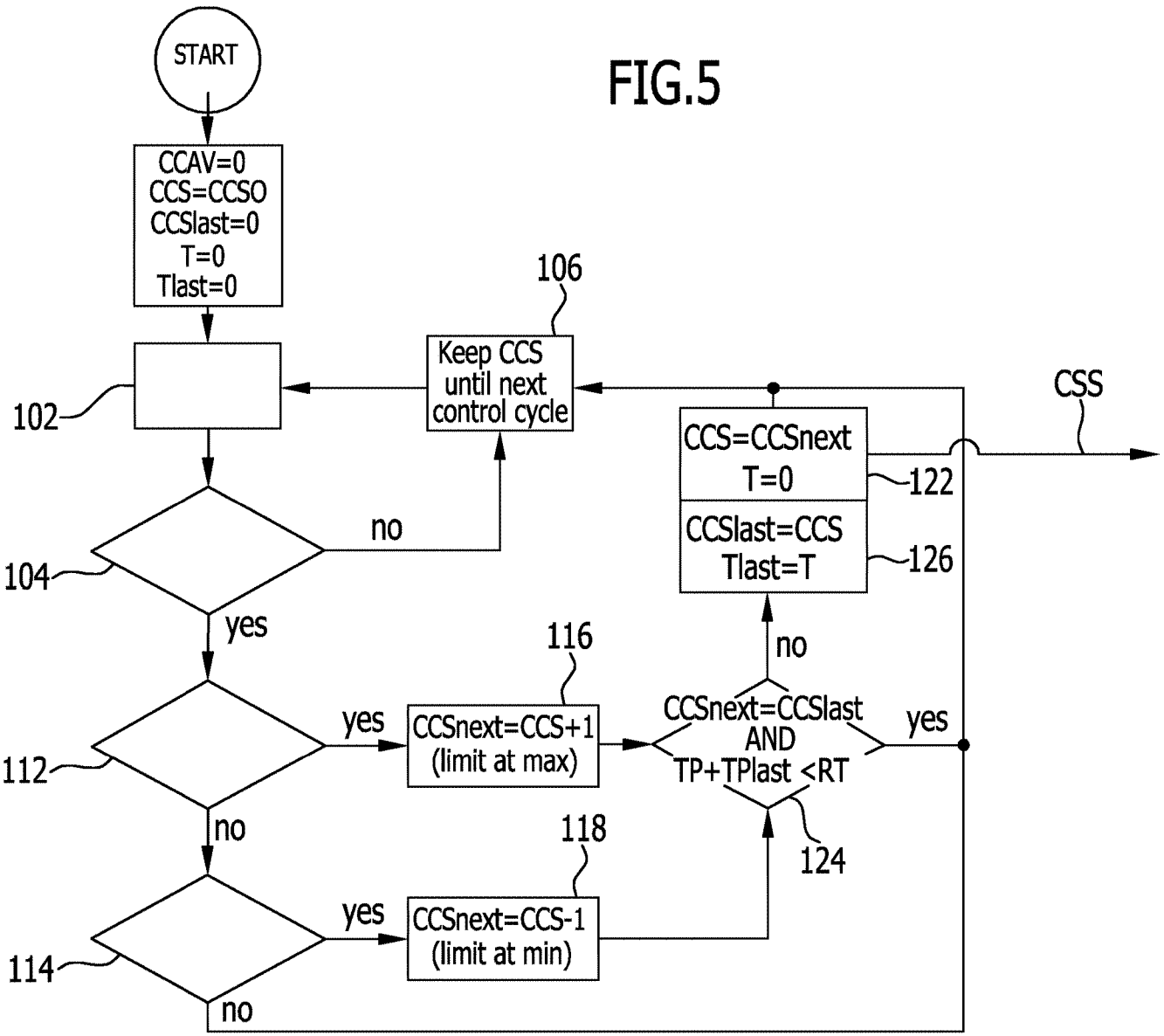
FIG. 5 shows a second embodiment of an algorithm according to the present invention.

In a second embodiment of the algorithm according to the present invention, as shown in FIG. 5, the calculation step 102, the timing step 104, the comparison steps 112 and 114 and the capacity raising step 116 as well as the capacity reducing step 118 are identical with the first embodiment.

However the second embodiment according to the inventive algorithm provides a reactivation limitation step 124 which follows after the capacity raising step 116 and the capacity reducing step 118 and is introduced before capacity selection step 122.

The reactivation limitation step 124 is only active if the next compressor capacity stage CCSnext is different from the current compressor capacity stage CCS and then compares the control signals $CS_1$ to $CS_3$ for the next compressor capacity stage CCSnext with the control signals $CS_1$ to $CS_3$ for the last compressor capacity stage CCSlast which has been existing before the current compressor capacity stage CCS.

If the reactivation limitation step 124 discovers that the control signals $CS_1$ to $CS_3$ for the next compressor capacity stage CCSnext will be the same as the control signals $CS_1$ to $CS_3$ for the last compressor capacity stage CCSlast, which means that the current compressor capacity stage CCS will be switched back to the last compressor capacity stage CCSlast, reactivation limitation step 124 requires that the sum of the time period TP which has passed after the last change of the compressor capacity stage CCS and the time period TPlast which has passed between the change before the last change and the last change has to be greater than a reactivation time RT. If this requirement is met in capacity selection step 122 a change of the current compressor capacity stage CCS will take place by amending the current compressor capacity stage CCS to correspond to the next compressor capacity stage CCSnext as defined in capacity raising step 116 or capacity reducing step 118.

If the time period TP+TPlast is shorter than the reactivation time RT no change of the compressor capacity stage CCS will take place and the control cycle moves to final algorithm step 106.

Further capacity selection step 122 is preceded by resetting step 126 resetting the last compressor capacity stage CCSlast to correspond to the current compressor capacity stage CCS and resetting the last time period Tlast to correspond to the current time period T.

Figure 6:
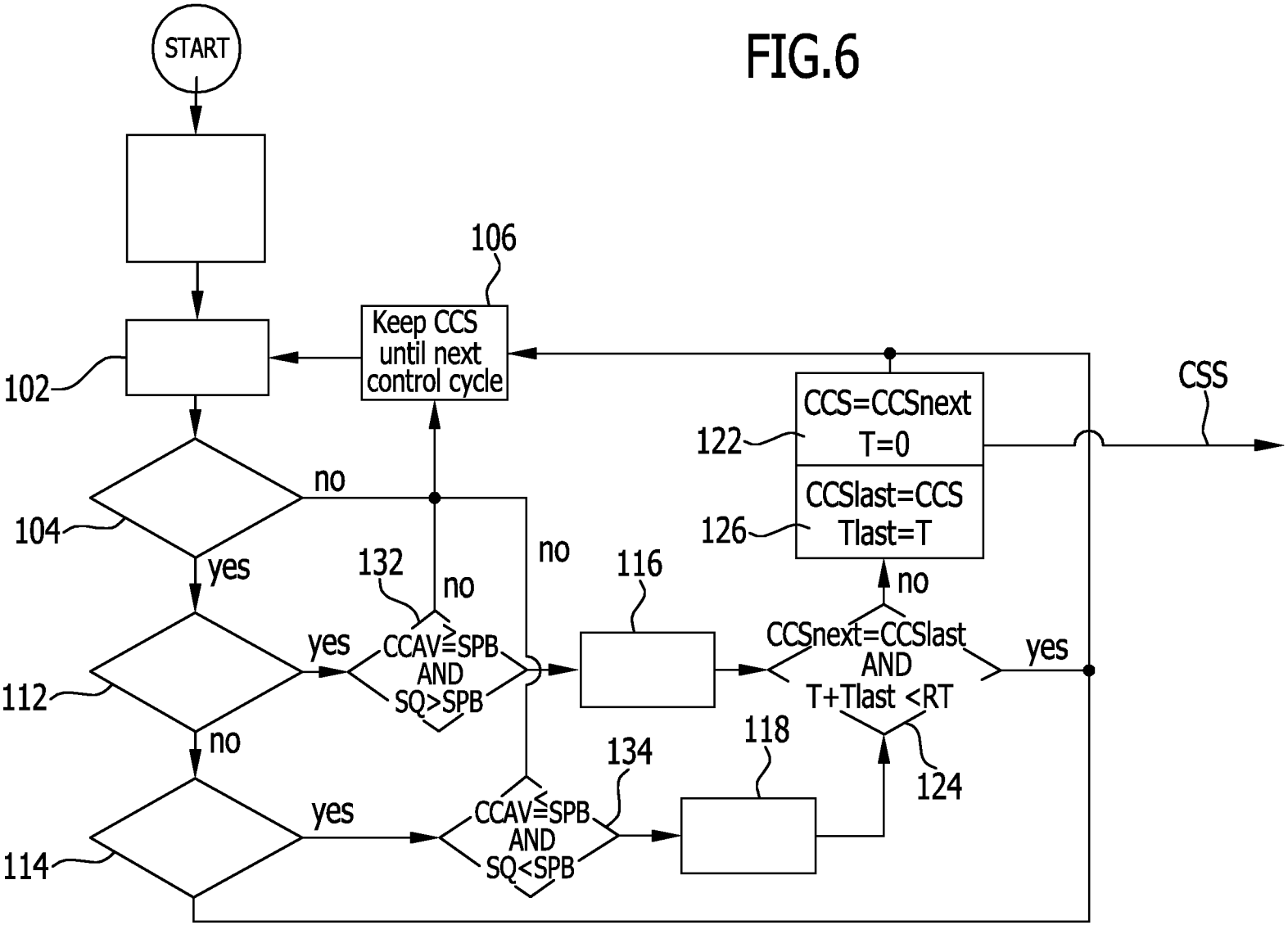
FIG. 6 shows a third embodiment of an algorithm according to the present invention and FIG. 7 shows a schematic representation of the operation of the capacity control system according to the third embodiment of the algorithm in case of three compressor capacity stages of the compressor system.

FIG. 6 shows an algorithm according to a third embodiment of the present invention.

In this algorithm the calculating step 102, the timing step 104, the final algorithm step 106, comparison steps 112, 114 as well as capacity raising step 116 and capacity reducing step 118 and also reactivation limitation step 124 as well as capacity selection step 122 and resetting step 126 are identical with the steps according to the second embodiment.

However the algorithm according to the third embodiment as a change rate limitation action associates a snap band SPB with each compressor capacity stage CCS which snap band SPB is then compared on one hand with the calculated capacity average value CCAV and a set quantity SQ, which can be for example either identical with the capacity set value CSV or even better with a capacity set average CSA which is calculated on the basis of the capacity set values CSV existing in the past over a certain time period as shown in FIG. 6.

For example the snap band SPB has a bandwidth in the range from 1% or more up to 5% or less of the maximum capacity so that the snap band SPB comprises also values deviating from the respective compressor capacity stage CCS the snap band SPB is associated with.

In case of a compressor capacity stage of for example 50% of the maximum compressor capacity the snap band SPB can have a bandwidth be in a range from 49% to 51% or more up to 45% to 55% or less.

The capacity set average CSA is calculated according to one of the same calculation processes as disclosed in connection with the calculation of the calculated capacity average value CCAV.

In order to consider the effect of the snap band SPB defined in connection with each of the existing compressor capacity stages CCS a snap band evaluation step 132 is provided between the comparison step 112 and capacity raising step 116 and also a snap band evaluation step 134 is provided between comparison step 114 and capacity reducing step 118.

In snap band evaluation step 132 the algorithm evaluates whether the calculated capacity average value CCAV is greater than the snap band SPB or within the snap band SPB and also evaluates whether the set quantity SQ, for example the capacity set value CSV or the capacity set average CSA, is greater than the snap band SPB.

If both conditions are met the next step will be the capacity raising step 116.

If these conditions are not met the next step will be final algorithm step 106 and the algorithm will start again with calculating step 102.

Snap band evaluation step 134 evaluates whether calculated capacity average value CCAV is smaller than snap band SPB or within the snap band SPB and also evaluates whether the set quantity SQ, for example the capacity set value CSV or the capacity set average CSA, is smaller than the snap band SPB.

If both conditions are met the next step will be capacity reduction step 118.

If these conditions are not met the next step will be final algorithm step 106 and the algorithm will then restart with calculation step 102.

Figure 7:
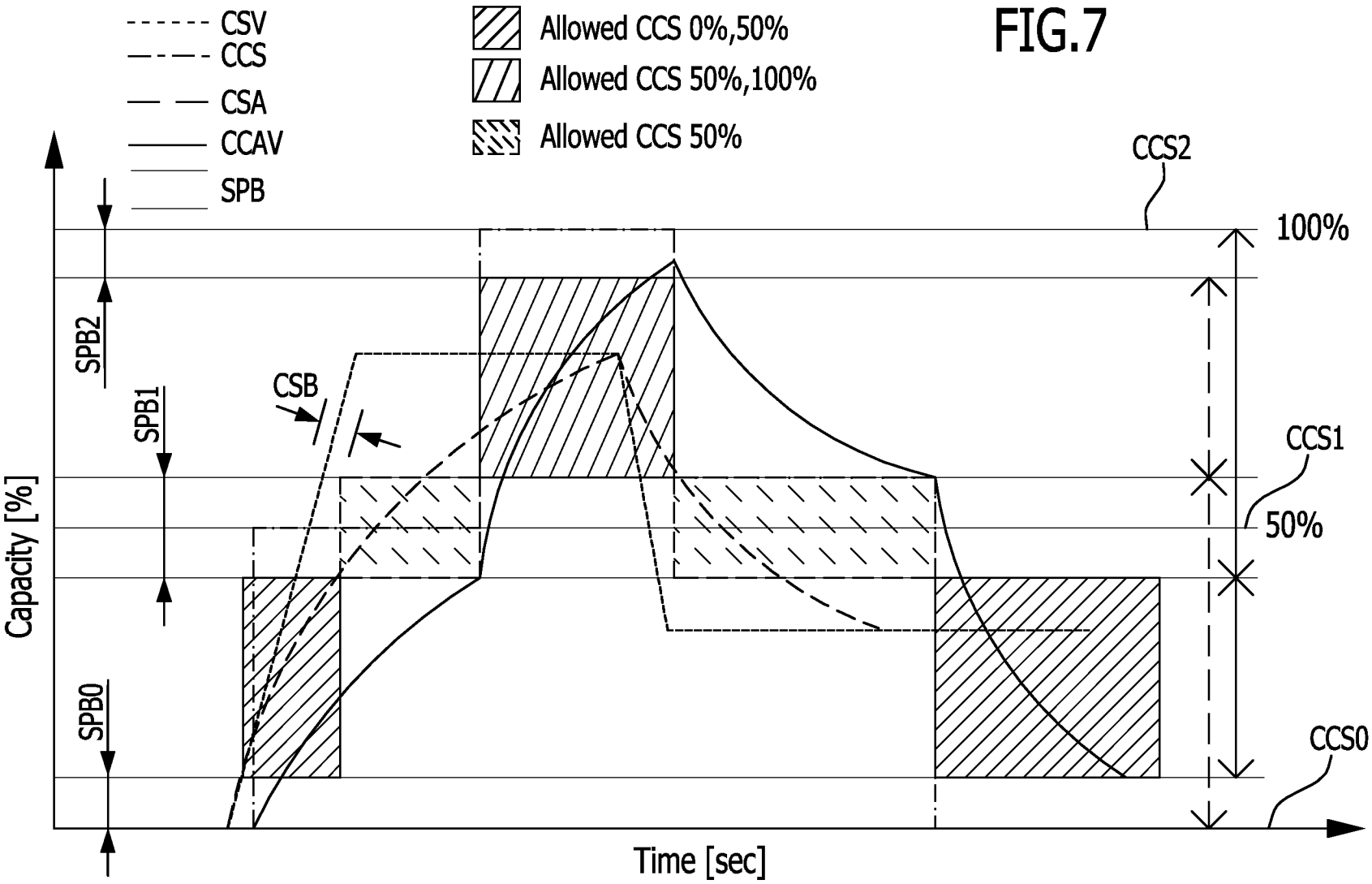

FIG. 7 demonstrates the operation of the algorithm according to the third embodiment by primarily focusing on the effect of the snap band SPB introduced in addition to the other embodiments of the algorithm.

In case of a compressor system 12 having three compressor capacity stages CCS, e.g. compressor capacity stage CCS0 corresponding to compressor capacity 0%, a compressor capacity stage CCS1 corresponding to a compressor capacity of 50% of the maximum compressor capacity and a compressor capacity stage CCS2 corresponding to a compressor capacity of 100% of the maximum compressor capacity.

As shown in FIG. 7 a snap band SPB is associated with each of the compressor capacity stages CCS, in particular a snap band SPB0 is associated with compressor capacity stage CCS0, a snap band SPB1 associated with compressor capacity stage CCS1 and a snap band SPB2 associated with compressor capacity stage CCS2.

As shown in FIG. 7 introduction of snap band evaluation steps 132 and 134 has the effect that in case the calculated capacity average value CCAV and the set quantity SQ are close to one of the compressor capacity stages CCS0, CCS1, CCS2 switching to a next lower or a next higher compressor capacity stage CCS is prohibited if not the value CCAV is within or outside snapband SPB and the set quantities SQ are outside snap band SPB in order to reduce the number of switching events per time unit and to stabilize the operation of the compressor system 12 at the existing compressor capacity stage.

The invention claimed is:

1. Method for controlling a compressor system, arranged in a heat pumping circuit, said compressor system being designed to be operated at at least two different compressor capacity stages, said compressor capacity stages being adjusted by a capacity adjustment system enabling switching from one compressor capacity stage to another compressor capacity stage, said capacity adjustment system being controlled by a capacity selection signal defining the compressor capacity stage to be selected, said method comprising determining a capacity set value, determining a decision quantity on the basis of said capacity set value, determining a calculated capacity average value on the basis of capacity selection signals generated before, comparing said calculated capacity average value with said decision quantity and changing said compressor capacity stage to the next higher stage if the calculated capacity average value is below the decision quantity or changing said compressor capacity stage to the next lower stage if the calculated capacity average value is above the decision quantity, or not changing said compressor capacity stage if the calculated capacity average value meets said decision quantity.

2. Method according to claim 1, wherein said capacity set value is calculated on the basis of a demand signal detected at a heat absorbing section of said heat pumping circuit and a user set value.

3. Method according to claim 1, wherein said calculated capacity average value is calculated by using a moving average.

4. Method according to claim 1, wherein said calculated capacity average value is calculated by using an exponential moving average.

5. Method according to claim 1, wherein said calculated capacity average value is calculated by using a modified moving average.

6. Method according to claim 1, wherein said calculated capacity average value is calculated by using an averaging period in the range from 10 seconds or more to 100 seconds or less.

7. Method according to claim 6, wherein said calculated capacity average value is calculated by using an averaging period in the range from 20 seconds or more to 90 seconds or less.

8. Method according to claim 1, wherein said method comprises use of said capacity set value as the decision quantity.

9. Method according to claim 1, wherein said method comprises a change rate limitation action.

10. Method according to claim 9, wherein said change rate limitation action comprises determining a capacity set value band on the basis of said capacity set value and using said capacity set value band as the decision quantity.

11. Method according to claim 10, wherein said capacity set value band is determined such that the respective capacity signal value is within said capacity set band.

12. Method according to claim 11, wherein said capacity set value band is determined to comprise deviations from the capacity set value in the range from ±1% to ±10% of the maximum capacity.

13. Method according to claim 9, wherein said change rate limitation action comprises the step of waiting at least for the expiry of a minimum time period after the last change of the compressor capacity stage before allowing a further change of the compressor capacity stage.

14. Method according to claim 13, wherein said minimum time period is in the range from 0.2 seconds or more to 10 seconds or less.

15. Method according to claim 13, wherein a comparison of the calculated capacity average value with the decision quantity is only made after expiry of the minimum time period.

16. Method according to claim 1, wherein a change from one current compressor capacity stage to a next compressor capacity stage obtained by control signals identical with the control signals of the last compressor capacity stage is only possible after a defined reactivation time period.

17. Method according to claim 13, wherein the reactivation time period is greater than the minimum time period.

18. Method according to claim 13, wherein the reactivation time period is greater than the duration of the current time period.

19. Method according to claim 9, wherein as a change rate limitation action each compressor capacity stage is associated with a snap band and wherein a change of the compressor capacity stage is prohibited in case a set quantity based on the capacity set value is within said snap band.

20. Method according to claim 19, wherein said snap band is determined to comprise deviations from said respective compressor capacity stage said snap band is associated within the range from ±1% or more up to ±5% or less of the maximum capacity.

21. Method according to claim 19, wherein a change of the compressor capacity stage is only allowed if said calculated capacity average value is within or above said snap band and said set quantity is above said snap band.

22. Method according to claim 19, wherein a change of the compressor capacity stage is only allowed if said calculated capacity average value is within or below the snap band and said set quantity is below said snap band.

23. Method according to claim 19, wherein said set quantity is said capacity set value.

24. Method according to claim 19, wherein said set quantity (SQ) is a capacity set average calculated on the basis of capacity set values existing before.

25. Method according to claim 24, wherein said capacity set average is calculated by using a moving average.

26. Method according to claim 24, wherein said capacity set average is calculated by using an exponential moving average.

27. Method according to claim 24, wherein said capacity set average is calculated by using a modified moving average.

28. Method according to claim 24, wherein said capacity set average is calculated by using an averaging period in the range from 10 seconds or more to 100 seconds or less.

29. Compressor system arranged in a heat pumping circuit, said compressor system being provided with a capacity adjustment system having a capacity adjustment device with capacity adjustment means and a capacity adjustment controller, said capacity adjustment controller is controlled by a capacity selection signal generated by a capacity control system operating according to the method of claim 1.

30. Compressor system according to claim 29, wherein said capacity adjustment means are controlling the operation of several compressors or compressor units in order to run the compressor system in various compressor capacity stages.

31. Compressor system according to claim 29, wherein said capacity adjustment means are valves.

32. Compressor system according to claim 31, wherein said valves are blocking or unblocking the flow of refrigerant to the respective compressors or the respective compressor units.

33. Compressor system arranged in a heat pumping circuit, said compressor system being provided with a capacity adjustment system having a capacity adjustment device with capacity adjustment means and a capacity adjustment controller, said capacity adjustment system and a capacity control system being functionally integrated into the compressor system in order to form a system unit fully operable in said heat pumping circuit in accordance with the method of claim 1 when supplied with a capacity set value.

* * * * *